US005165220A

United States Patent [19]

Puett

[11] Patent Number: 5,165,220

[45] Date of Patent: Nov. 24, 1992

[54] OPEN LOADING SKIN PACKAGING MACHINE

[75] Inventor: Cecil E. Puett, Downey, Calif.

[73] Assignee: Suclipse, Inc., Montebello, Calif.

[21] Appl. No.: 756,327

[22] Filed: Sep. 6, 1991

[51] Int. Cl.[5] ..... B65B 11/52

[52] U.S. Cl. ..... 53/509; 53/427

[58] Field of Search ..... 53/427, 509, 433, 511

[56] References Cited

U.S. PATENT DOCUMENTS

| | | | |
|---|---|---|---|
| 3,071,905 | 1/1963 | Morse | 53/509 X |
| 3,371,464 | 3/1968 | Swick | 53/509 |
| 3,491,504 | 1/1970 | Young et al. | 53/509 X |
| 3,910,008 | 10/1975 | Johnson | 53/509 |
| 4,077,184 | 3/1978 | Kremer et al. | 53/509 |
| 4,188,770 | 2/1980 | Tabur | 53/509 |
| 4,480,425 | 11/1984 | Furukawa | 53/509 |
| 4,598,527 | 7/1986 | Hollingsworth et al. | 53/509 X |

*Primary Examiner*—John Sipos
*Assistant Examiner*—Linda B. Johnson
*Attorney, Agent, or Firm*—William H. Pavitt, Jr.; Daniel L. Dawes; Mario A. Martella

[57] ABSTRACT

Apparatus for skin packaging articles on a backing card in which a heating unit for film is disposed behind a work table having a vacuum platen on which may be placed a backing card with an article to be packaged; and, upon activation, is moved vertically between a first position above the level of the table and a second position not higher than the table level. A film clamping frame holds a section of film closely above the heating unit when it is in its first position, and when the unit is moved to its second position, moves the heated clamped film section forward and downward onto a backing card where it is drawn down tightly against the article on the card upon creation of a vacuum. Upon completion of the packaging, the backing card is pulled forwardly off the table and its film is severed from the further film which is pulled with it, such further film then being clamped on the film clamping frame which is moved back up to its elevated position for repetition of the cycle.

7 Claims, 2 Drawing Sheets

OPEN LOADING SKIN PACKAGING MACHINE

FIELD OF THE INVENTION

This invention relates generally to apparatus for packaging articles on cards or backing boards with some type of film which may be vacuum fitted about the article or articles, a process, sometimes known as "shrink wrapping".

BACKGROUND OF THE INVENTION

The present invention represents an improvement over the type of apparatus which is the subject of U.S. Pat. No. 5,069,018 with the application for which this application was co-pending. The apparatus described in that patent includes a base with a stationary heating hood. A rectangular stationary packaging table is mounted on the base and extends laterally outwardly from beneath the heating hood. A movable rectangular sealing frame is mounted on the base beneath the heating hood and over the packaging table. This sealing frame includes a top frame portion and a bottom frame portion which are hingedly connected together. The top frame portion is hingedly movable between an open position and a closed position relative to the bottom frame portion. In the open position, the top frame portion is pivoted away from the bottom frame portion to allow loading of a sheet of plastic film between the top frame portion and the bottom frame portion. Also, movement of the top frame portion into the open position allows removal of the final package product from the machine. When the top frame portion is moved into the closed position, the top frame portion is placed against the bottom frame portion to hold the plastic sheet taut between the two frame portions. The sealing frame is connected to the base and can be moved to a heating position wherein the sealing frame and plastic sheet held by the frame are positioned below the heating hood. The sealing frame can also be moved to a sealing position, wherein the sealing frame and the plastic sheet are positioned on the packaging table where a vacuum condition may be created to draw the heated plastic sheet over the article to be packaged against the underlying card on the table.

Providing a heating hood above the film in its heating position is typical of the prior art, such as has been cited and discussed during the prosecution of the earlier patent. This may require that the heating elements in the heating hood be maintained in continuous energized condition, particularly where the interval between exposures of plastic film sheets to the heating element may be relatively brief and the desired time of exposure likewise may be brief. However, when the heating element is continually energized, this is not only wasteful of electrical energy (and can also be expensive), but in certain work environments, such as an unair-conditioned plant in the summer, can greatly increase discomfort for the operator of the machine. Also, since the heating element radiates downwardly below the hood, considerable heat energy is required.

SUMMARY OF THE INVENTION

The present invention obviates certain disadvantages of prior art apparatus, including that of the prior patent hereinabove referred to, by providing a heating element or elements which are disposed behind the packaging table and, in one position, below the level of the same and, in a second position, the heating elements are elevated above the level of the table to just below a frame containing the film to be heated, at which point the heating element or elements are simultaneously energized. After the proper heating interval, the heating elements may be de-energized and retracted to their first position and the frame is then moved onto the table to place the heated film over the article and it backing card, at which point, the vacuum condition is created to, in effect, shrink back the film about the article and on the card. Film is supplied to the frame from a continuous roll disposed at the rear of the apparatus. Film thus may be continually fed to the film frame for passage over the heating elements and to the vacuum table. After packaging, the film may be severed by cutting means which are provided on the forward end of the frame.

Means are further provided to cycle the several steps in sequence once the film has been clamped in the frame.

Because the heating element or elements are below the path of the film and heat naturally rises, less heat is needed to activate adhesive on the film. Moveover, since the heating elements are retracted during a certain portion of the cycle, they may be de-energized and only energized as they are brought up to the heating position. This not only results in the utilization of less electrical energy, but, since the heat is applied locally and for relatively brief intervals, no oven-like condition and ambient discomfort to the operator, are created as is the case with use of of a heating hood typical of prior art apparatus.

DESCRIPTION OF THE DRAWINGS

In the accompanying drawings.

DESCRIPTION OF THE PREFERRED EMBODIMENT

Figure 1:
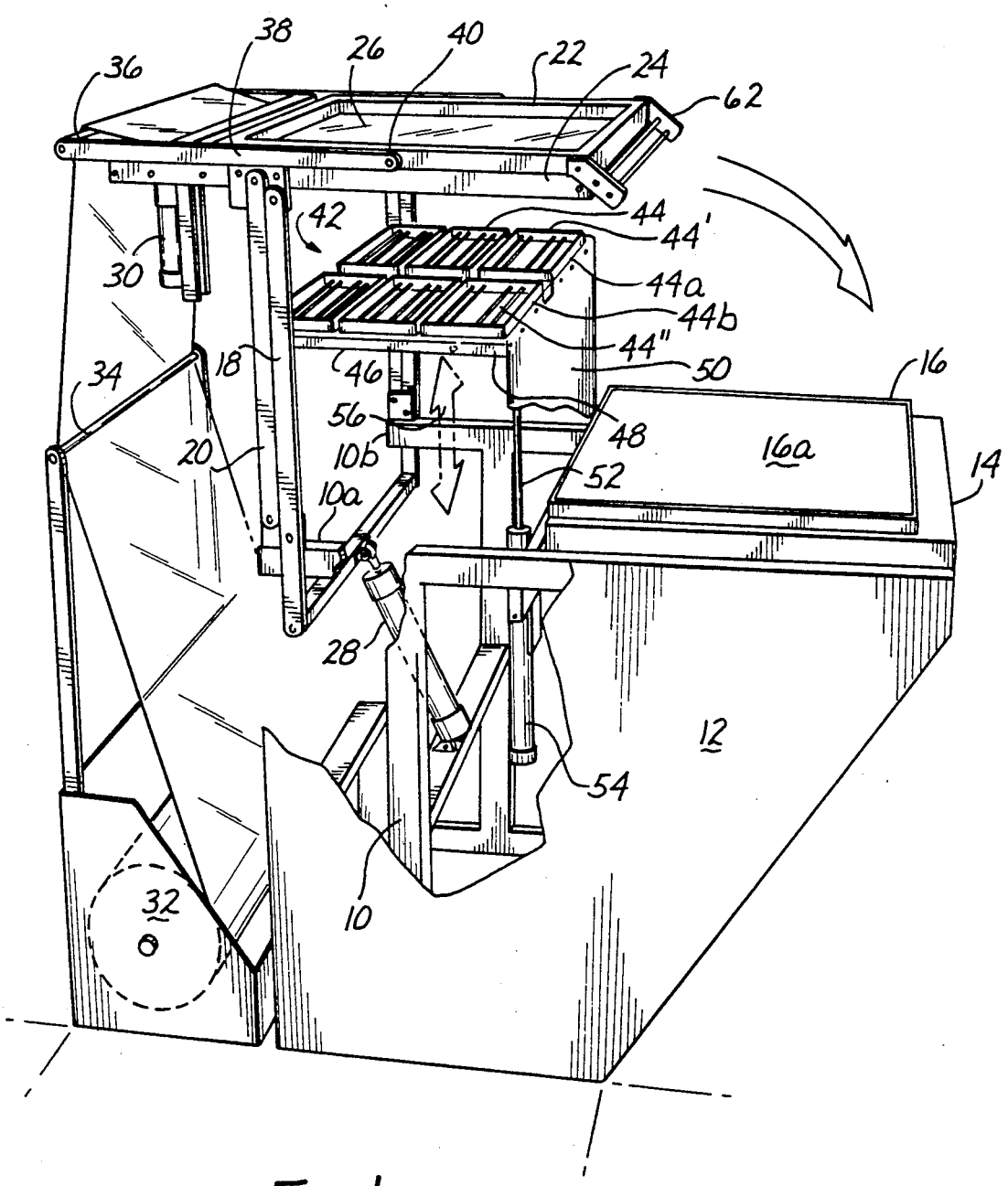
FIG. 1 is a perspective view partially broken away showing the apparatus.

Referring to FIG. 1 of the drawings, the apparatus of the present invention comprises a base frame 10 which may have a cover 12 on its sides and front end, and supporting a work table 14 over part of which is a vacuum platen 16. Articulated elements 18 and 20 pivotably secured to the horizontal members **10*a* and 10*b* of the base frame 10, pivotably support upper and lower film carrying frame members 22, 24 to swing them between the first position shown in FIG. 1 and a second position in which the framed film 26 has been transported down to the vacuum platen 16. This movement may be accomplished by the action of the pistons 28 and 30. The film 26 is initially brought up from the roll 32 over the bar 34 and end 36 of the U-shaped frame 38 which is pivotably mounted on the sides of the frame 22 at 40**.

The heating unit 42 may comprise a plurality of individual electric heaters 44 which are carried on a frame 46 mounted on a cross bar 48. A shield 50 is interposed between the front edges **44*a* and 44*b* of the forward heaters 44' and 44'' respectively. The upper edge of the shield 50 may be secured to the transverse bar 48. The rod 52 of pneumatic piston 54 is connected to the bar 48 so that the bar and the entire heating unit 42 will move upwardly or downwardly, as shown by the arrow 56. Push button control means 58 are provided on the front panel 14** of the machine to actuate an electrical system (not shown) by which the apparatus may be cycled to operate in the following manner:

Film 26 is pulled up from the roll 32 over the bar 34 and end 36 of the frame 38 to be secured in the frame 38 between the lower and upper frame members 24, 26 respectively in the manner disclosed in the earlier application hereinabove referred to. After the film 26 is thus secured between the frame members 22 and 24, one of the buttons 56 is pressed to actuate the cylinder 54 to push up the heater unit 52 from its position shown in FIG. 2 to that shown in FIG. 1, and the several individual heaters 44, are energized for an appropriate period sufficient to activate adhesive provided on the underside of the film 26, or simply to soften the film. After heating has been provided for a proper predetermined time, a second of the buttons 56 is pressed to further cycle the machine to cut off the electric current to the heaters 44 and simultaneously actuate the piston 52 to draw the rod 52 downwardly, pulling with it the heating unit 42 to the position shown in FIG. 2. Simultaneously, when the withdrawal has been accomplished, the piston 28 is actuated to push the frame 18 upwardly and rearwardly, thereby swinging the frame members 22, 24 forwardly and downwardly onto the vacuum platen 16 so that the film 26 between the frame members 22 and 24 will cover any article disposed on a backing board placed upon the face 16*a* of the vacuum platen 16. The vacuum creating unit is immediately actuated to draw the film 26 tightly over the article and the backing board.

Figure 2:
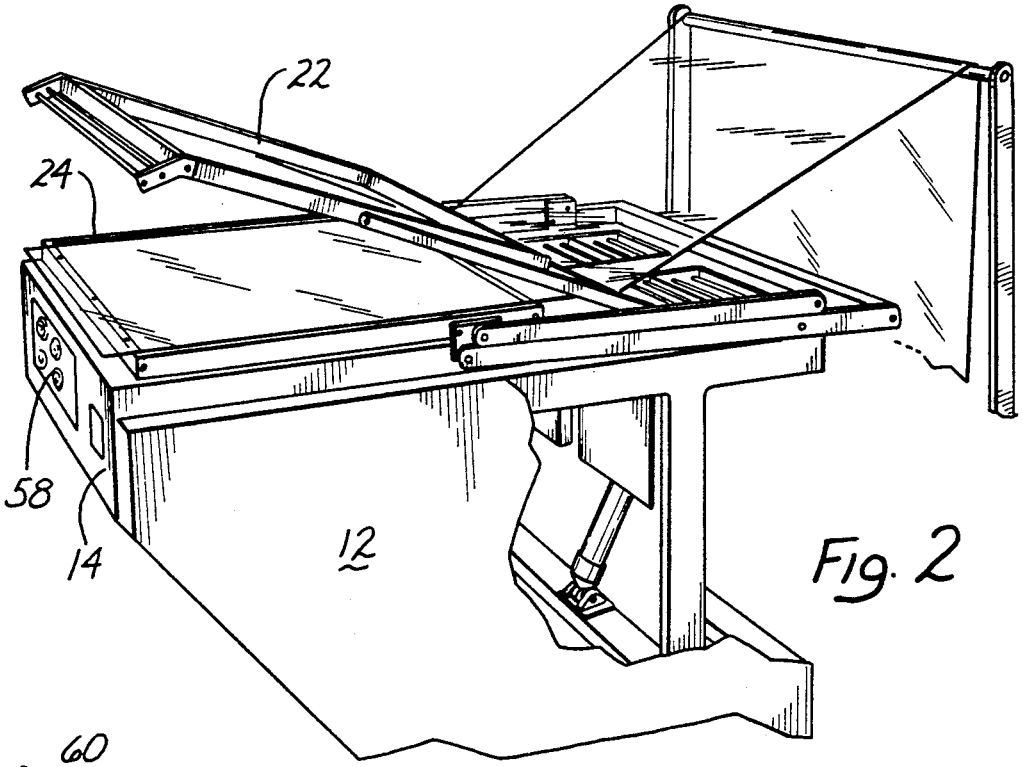
FIG. 2 is a partial perspective view also broken away taken from the opposite side of the apparatus as shown in FIG. 1 with the heating elements retracted and the film frame moved onto the table.
Figure 3:
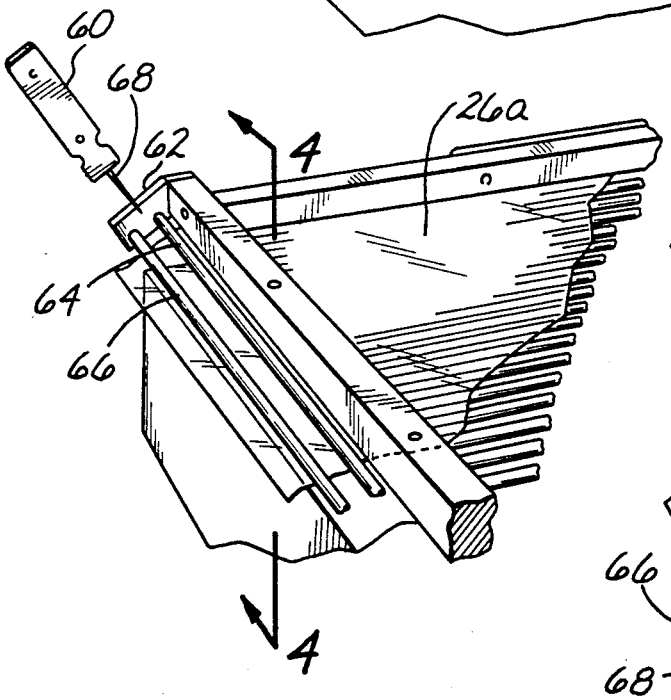
FIG. 3 is an enlarged partial view of the left front corner of the apparatus shown in FIG. 2.
Figure 4:
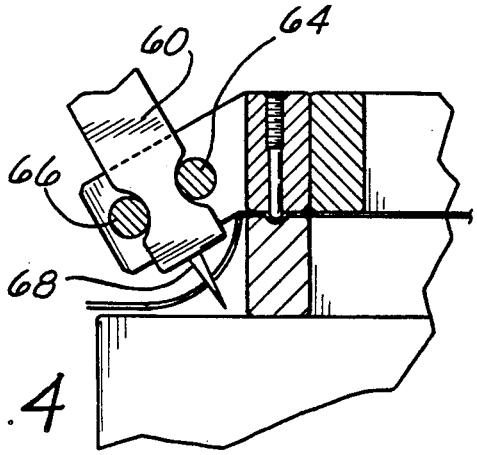
FIG. 4 is a section taken on the line 4—4 in the direction of the arrows.

When this has been accomplished, the top part 22 of the film carrying frame is then raised as shown in FIG. 2, and the board with the packaged article is pulled forwardly off the table, whereupon the top part 22 is then brought down tightly against the lower frame 24 to clamp that part of the film 26 which has been pulled forward with the packaged card. At this point, the cutter means 60 with its blade 68, which means is provided in the extension 62 of the top frame 22 and is retained in such extension 62 by means of the rods 64 and 66 as shown in FIGS. 3 and 4, is drawn across the film 26 to sever that portion of the film which is thus clamped between the upper and lower frames 22, 24 respectively, from the trailing edge of the film secured to the packaging card (not shown).

After such severance of the film, the return button of the buttons 56 is pushed to actuate the piston 28 to pull the frames 22, 24, through the articulated members 18, 20, back to the initial position shown in FIG. 1. At this point, a new backing board and article to be packaged thereon may be placed upon the vacuum platen 16 and the machine again cycled in the manner which has been described.

From a consideration of the foregoing disclosure, it will be appreciated that the apparatus of the present invention provides a simple means for a operator to "skin package" articles on a backing board with a minimum use of electrical energy to provide heat necessary to actuate the adhesive on, or soften a film for "skin packaging". Because the heating unit is disposed below the film and heat rises, a minimum amount of heat will be required, and further energy saving is effected by cutting off current to the heater during a substantial portion of the complete packaging cycle. This also results in lower ambient temperature in the vicinity of the apparatus and consequent greater comfort for the operator.

I claim:

1. An open loading packaging machine comprising:

a support frame;

a packaging table stationarily mounted horizontally on said frame at a predetermined level for convenient manual work on said table, said packaging table providing an area to receive a backing board upon which may be placed an article to be packaged on said board, said table further having means associated with the table to create a vacuum below said area when a backing board is placed thereon;

at least one heating element mounted behind said table and movable vertically between a first lower position not above the level of the table, and a second position above said table level;

means to move said heating element between its said first and second positions;

a film carrying frame, a roll of film disposed rearward of the support frame, the outer edge of said roll being drawn over and onto said film carrying frame and secured at the forward end of such frame, said film when heated being adapted to adhere to an object against which it may be pressed; and articulated members associated with the support frame and pivotally attached to the film carrying frame to support said frame;

means to actuate said articulated members to move the film carrying frame between a first horizontal position above the heating element and a second position on top of the packaging table to dispose film carried by the frame over said backing board and any article placed upon it;

means to cycle said machine in the following sequence:

first, the movement of the heating element from its first to its second position below the film in the film carrying frame when said frame is in its first position, and to energize the heating element;

secondly, retraction of the heating element to its first position while simultaneously moving the articulated members to shift the film carrying frame from its first position to its second position and, when so disposed, to activate the means associated with the table to create a vacuum below the board receiving area, thereby applying the film to cover any object on the board to "skin package" said object; and lastly, to return the film carrying frame to its first position after the film covered board has been removed forwardly from the table and film from the roll drawn forwardly with the board has been severed therefrom.

2. The machine as described in claim 1 wherein the heating element comprises a transverse support bar which carries at least one electrical heating element and shielding between the heater and the packaging table.

3. The machine as described in claim 2 wherein the support bar is moved vertically to dispose the heating element either in its first or second position by means of a piston and rod.

4. The machine as described in claim 1 wherein the cycling means, upon retracting the heating element to its first position simultaneously de-energizes said element.

5. The machine as described in claim 1 wherein cutting means are provided at the forward end of the film carrying frame, said cutting means being movable transversely across the film protruding from the forward end of the frame after the board has been pulled forwardly from the table carrying with it further film which has not been applied to the board.

6. The machine as described in claim 1 wherein male and female interlocking elements are provided on the film carrying frame and the table to enable the heated film carried by the frame to be better held against the vacuum area.

7. An open loading packaging machine, said machine having:

a support frame, a work table associated with said frame, said table providing an area on which to place a backing board and a vacuum for said area, said table having a front end at which the operator may stand and a back end;

a source of continuous sheet film behind the back end of the table, said film when heated being adapted to adhere to an object against which it may be pressed;

means associated with said frame to carry said film from said source via a path above the level of the table and down to the backing board;

a heating element disposed in a first position below the level of said table, means to elevate said heating element from its first position to a second position above the work table and below and more adjacent the film as it is carried via said path, said heating element when energized directing heat upwardly against the underside of the film travelling via said path, to heat the film; and means to create a vacuum about said area when the heated film is disposed on the backing board.

* * * * *